US007125366B1

(12) United States Patent
Yeh

(10) Patent No.: US 7,125,366 B1
(45) Date of Patent: Oct. 24, 2006

(54) SIT UP EXERCISING APPARATUS

(76) Inventor: Julia Yeh, No. 7, Alley 39, Lane 16, Sianyan Rd., Taipei (TW)

( * ) Notice: Subject to any disclaimer, the term of this patent is extended or adjusted under 35 U.S.C. 154(b) by 0 days.

(21) Appl. No.: 11/217,380

(22) Filed: Sep. 2, 2005

(30) Foreign Application Priority Data

Jul. 27, 2005 (TW) ..... 94212756 U

(51) Int. Cl.
*A63B 23/02* (2006.01)
*A63B 21/02* (2006.01)

(52) U.S. Cl. ..... 482/140; 482/122; 482/130; 482/142

(58) Field of Classification Search ..... 482/122, 482/129, 130, 133, 140, 142, 907, 72; D21/676, D21/687, 690
See application file for complete search history.

(56) References Cited

U.S. PATENT DOCUMENTS 5,215,511 A * 6/1993 Cheng ..... 482/121
5,453,066 A * 9/1995 Richter, Jr. ..... 482/96
5,533,953 A * 7/1996 Lui et al. ..... 482/96
5,624,361 A * 4/1997 Lai ..... 482/130
5,643,147 A * 7/1997 Huang ..... 482/72
5,833,590 A * 11/1998 Chiu et al. ..... 482/142
6,258,016 B1 * 7/2001 Kuo ..... 482/142

* cited by examiner

*Primary Examiner*—Jerome Donnelly
*Assistant Examiner*—Allana Lewin
(74) *Attorney, Agent, or Firm*—Troxell Law Office, PLLC

(57) ABSTRACT

A sit up exercising apparatus has a seat assembly, an actuating bar The seat assembly has front leg, a cushioned seat and a rear leg. The actuating bar is attached pivotally to the seat assembly and provides an elastic force to assist a person using the sit up exercising apparatus and has multiple rollers. The rollers massage a person's back who is using the sit up exercising apparatus. Consequently, a person's backbone is not likely to be injured, and the exercising force can be adjusted to accommodate individual users based on their age or physical condition.

5 Claims, 7 Drawing Sheets

SIT UP EXERCISING APPARATUS

BACKGROUND OF THE INVENTION

1. Field of the Invention

The present invention relates to a sit up exercising apparatus, and particularly relates to a sit up exercising apparatus on which the exercising force required for a user to sit up can be adjusted based on the user's age or physical condition.

2. Description of Related Art

Different exercising apparatuses are available to exercise different parts of a user's body such as chest, legs, arms, waist and the like. A sit up exercising apparatus is used to exercise a person's waist. A conventional sit up exercising apparatus generally comprises a padded board and an ankle strap. The padded board has a bottom end and a bead end and is generally mounted horizontal like a bench. The padded board on some advanced versions of the conventional sit up exercising apparatus can raise the bottom end of the padded board to increase the force required to do a sit up. However, sit up exerciser do not have the capability to reduce the force required to do a sit up. The ankle strap is attached to the board at the bottom end. To use the conventional sit up exerciser, a user lies on the padded board with his or her feet through the ankle strap and sits up to exercise his or her waist. However, constantly pressing a person's backbone against the padded board may be uncomfortable or injure the backbone of a weak user.

Therefore, the invention provides a sit up exercising apparatus to mitigate or obviate the aforementioned problems.

SUMMARY OF THE INVENTION

The main objective of the present invention is to provide a sit up exercising apparatus that can keep a user's backbone from being injured and adjust the exercising force required for a particular user based on his or her age and physical condition.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
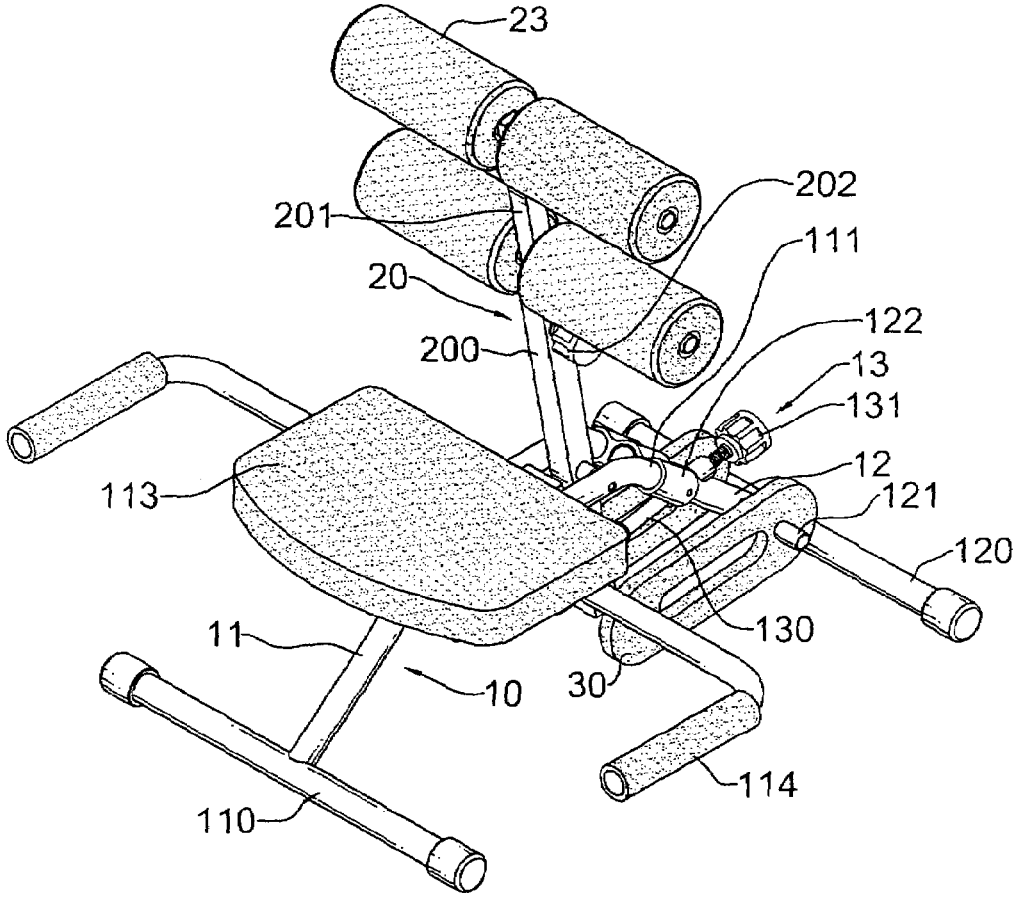
FIG. 1 is a perspective view of a sit up exercising apparatus in accordance with this invention.
Figure 2:
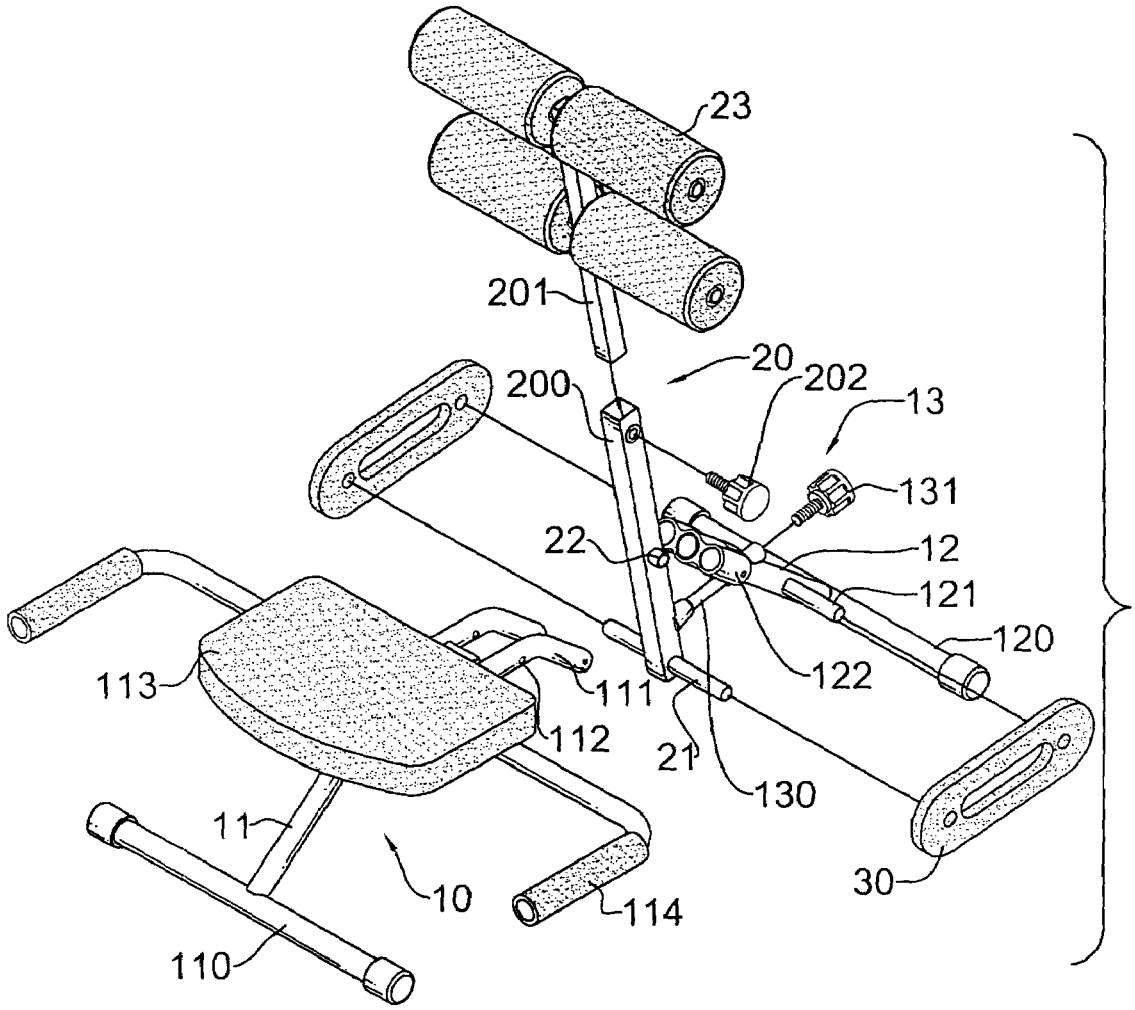
FIG. 2 is a partially exploded perspective view of the sit up exercising apparatus in FIG. 1.

With reference to FIGS. 1 and 2, a sit-up exercising apparatus in accordance with the present invention comprises a seat assembly (10), an actuating bar (20) and two elastic members (30).

The seat assembly (10) comprises a front leg (11), a cushioned seat (113), an optional handlebar (114) and a rear leg (12).

The front leg (11) is an inverted spread U-shape and has a distal end, a proximal end, a flat middle section, a front foot (110) and a forked connector (111).

The front foot (110) is connected transversely to the distal end of the front leg (11) and comprises a pipe and two caps. The pipe is connected transversely to the distal end of the front leg (11) and has two ends. The caps are mounted respectively on the ends of the pipe.

The forked connector (111) is formed at the proximal end of the front leg (11) and has two tines and two pivot holes (112). The pivot holes (112) are defined respectively in the tines and align with each other.

The cushioned seat (113) is mounted on the flat middle section of the front leg (11) and has two sides.

The handlebar (114) is mounted under the cushioned seat (113) and has two ends and two grips. The ends extend respectively out from the sides of the cushioned seat (113), and the grips are mounted respectively on the ends.

The rear leg (12) is connected to the front leg (11) and has a distal end, a rear foot (120), a forked proximal end, two sleeves (122), an adjusting device (13) and a stationary mounting rod (121).

The rear foot (120) is connected transversely to the distal end of the rear leg (12) and comprises a pipe and two caps. The pipe is connected transversely to the distal end of the rear leg (12) and has two ends. The caps are mounted respectively on the ends of the pipe.

The forked proximal end has two tines and a gap. The gap is formed between the tines.

The sleeves (122) are connected respectively to and protrude from the tines of the forked proximal end and are mounted respectively over and connected to the tines of the forked connector (111) of the front leg (11).

Figure 7:
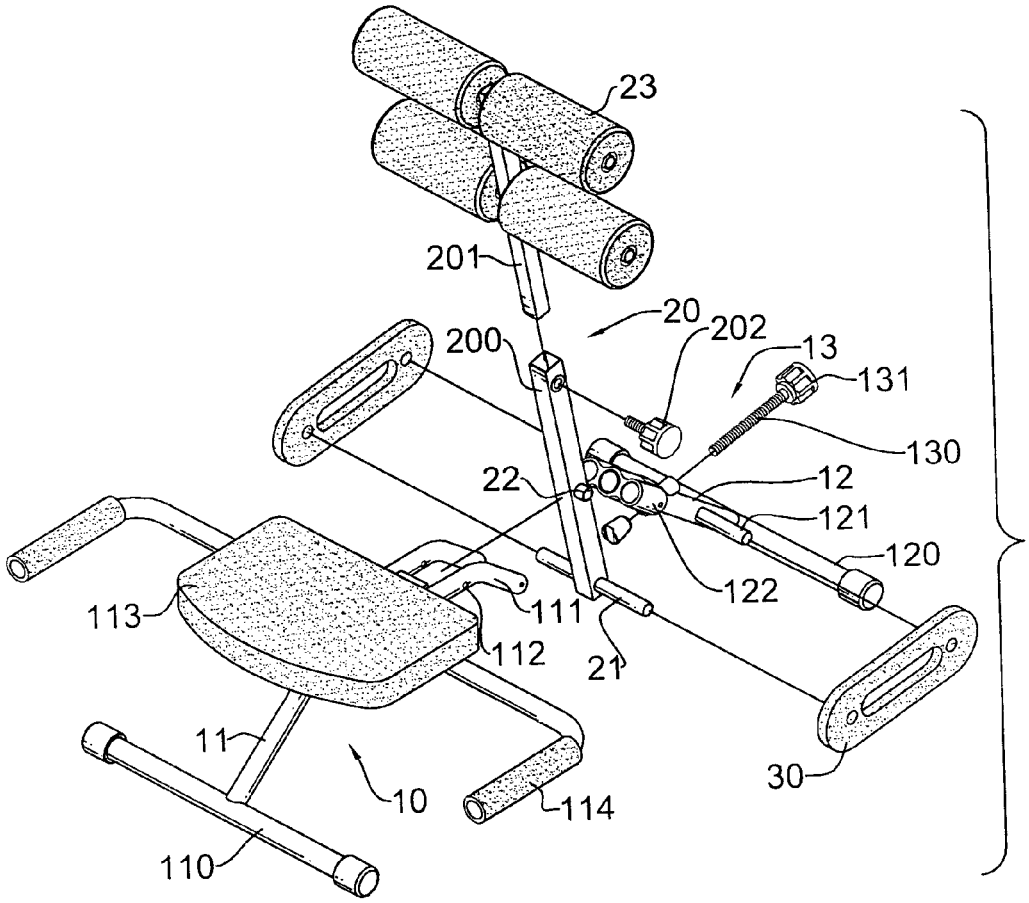
FIG. 7 is a partially exploded perspective view of another embodiment of the sit up exercising apparatus in accordance with the present invention.

The adjusting device (13) is mounted between the tines of the forked proximal end of the back leg (12) and comprises an extension rod (130) and an adjustment knob (131). In one embodiment of the adjusting device (13), the extension rod (130) has a proximal end and a distal end, and the adjustment knob (131) is rotatably connected to the proximal end of the extension rod (130) and turns in two directions. The adjustment knob (131) has a threaded rod, and a threaded hole is defined in the rear leg (12) and engages with the threaded rod on the adjusting knob (131). When the adjustment knob (131) is rotated, the adjustment knob (131) with the extension rod (130) will move relative to the rear leg (12). With further reference to FIG. 7, the adjustment knob (131) and the extension rod (130) are formed as a single piece in another embodiment of the adjusting device (13). Turning the adjustment knob (131) in one direction extends the extension rod (130). Turning the adjustment knob (131) in the opposite direction retracts the extension rod (130).

The stationary mounting rod (121) is mounted through and protrudes out transversely from the rear leg (12) between the forked proximal end and the distal end.

The actuating bar (20) is mounted pivotally between the tines of the forked connector (111), abuts the adjusting device (13) and has a proximal end, a distal end, opposite sides, a movable mounting rod (21), two pivot pins (22) and multiple rollers (23) and may be comprised of an outer shaft (200), an inner shaft (201) and a setscrew (202).

The proximal end abuts the adjusting device (13).

The movable mounting rod (21) is mounted transversely through the proximal end of the actuating bar (20) and can be moved away from or toward the stationary mounting rod (121) by turning the adjusting knob (131) on the adjusting device (13).

The pivot pins (22) are connected to and protrude from opposite sides of the actuating bar (20) between the proximal end and the distal end and correspond to and are mounted respectively in the two pivot holes (112) in the tines of the forked connector (111) of the front leg (11).

The rollers (23) are connected to and protrude out transversely from the actuating bar (20) near the distal end and massage a person leaning against the rollers (23) and operating the sit-up exercising apparatus.

The outer shaft (200) is hollow, abuts the adjusting device (13) and has a proximal end, a distal end, opposite sides and a threaded setscrew hole. The proximal end abuts the adjusting device (13). The movable mounting rod (21) is mounted transversely through the proximal end of the outer shaft (200) and can be moved away from or toward the stationary mounting rod (121) by turning the adjusting knob (131) on the adjusting device (13). The pivot pins (22) are connected to and protrude from opposite sides of the outer shaft (200) between the proximal end and the distal end and correspond to and are mounted respectively in the two pivot holes (112) in the tines of the forked connector (111) of the front leg (11).

The threaded setscrew hole is formed through one side of the outer shaft (200) near the distal end.

The inner shaft (201) is mounted in and protrudes from the distal end the outer shaft (200) and has a proximal end, a distal end and multiple rollers (23). The proximal end is mounted slidably in the distal end of the outer shaft (200). The rollers (23) are connected to and protrude out transversely from the inner shaft (201) near the distal end and massage a person leaning against the rollers (23) and operating the sit-up exercising apparatus.

The setscrew (202) screws into the threaded setscrew hole in the outer shaft (200) to hold the inner shaft (201) in place and has a threaded rod and a knob. The threaded rod screws into the threaded setscrew hole and presses against the inner shaft (201). The knob allows a user to loosen and tighten the setscrew (202) so the inner shaft (201) can be adjusted to accommodate a particular user.

Figure 3:
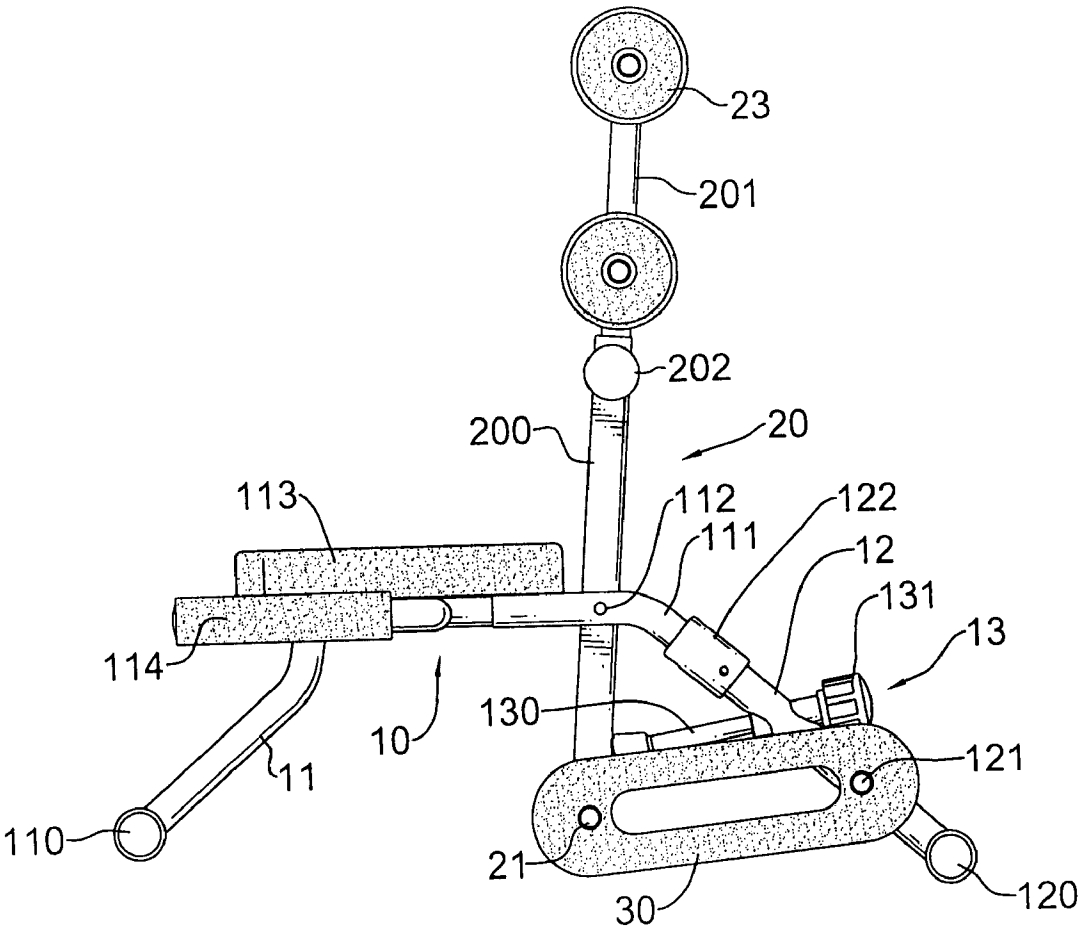
FIG. 3 is a side view of the sit up exercising apparatus in FIG. 1.
Figure 4:
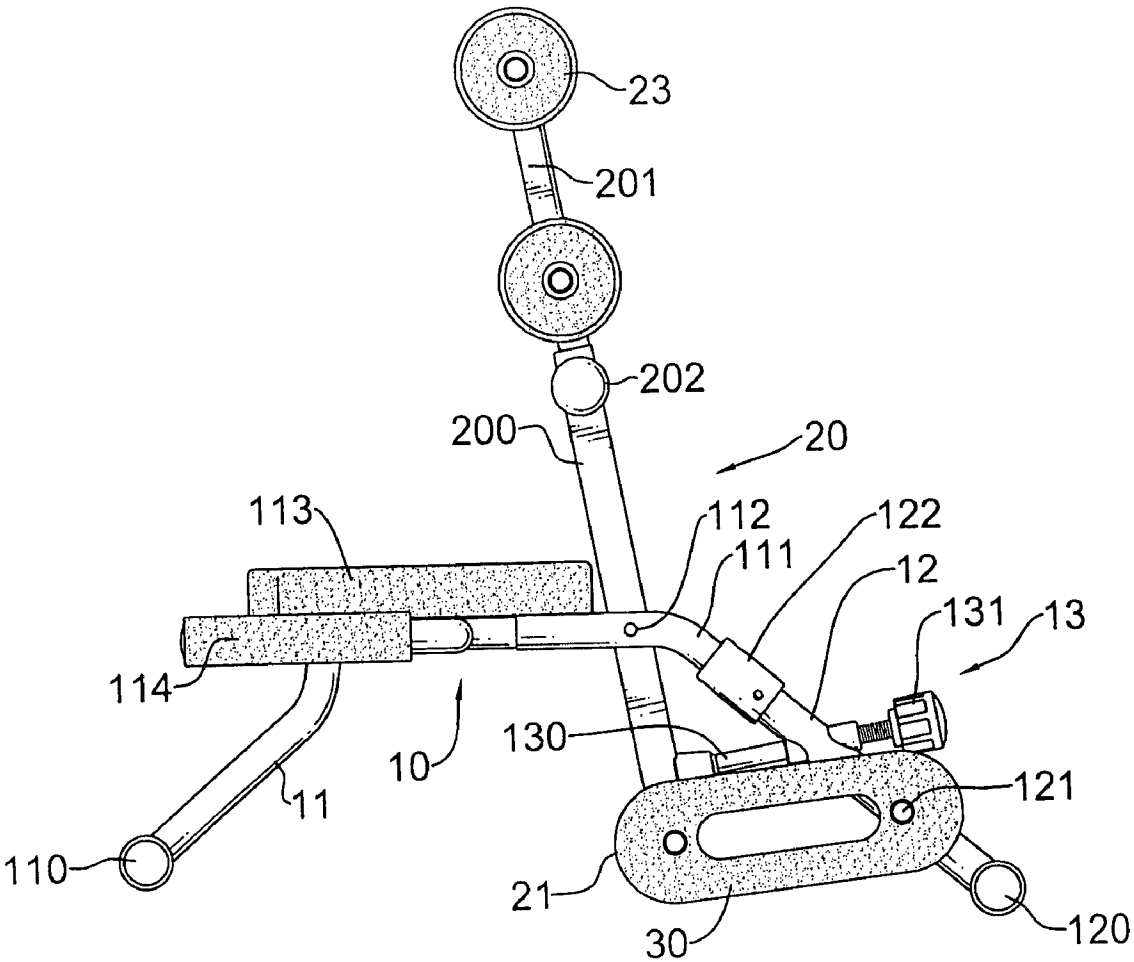
FIG. 4 is an operational side view of the sit up exercising apparatus in FIG. 1.

Each elastic member (30) is connected to the stationary mounting rod (121) and the movable mounting rod (21) and has two ends and two holes. The holes are formed respectively near the ends to hold the stationary and movable mounting rods (121, 21). With further reference to FIGS. 3 and 4, the force required to sit up can be changed by moving the movable mounting rod (21) relative to the stationary mounting rod (121) with the adjusting device (13).

Figure 5:
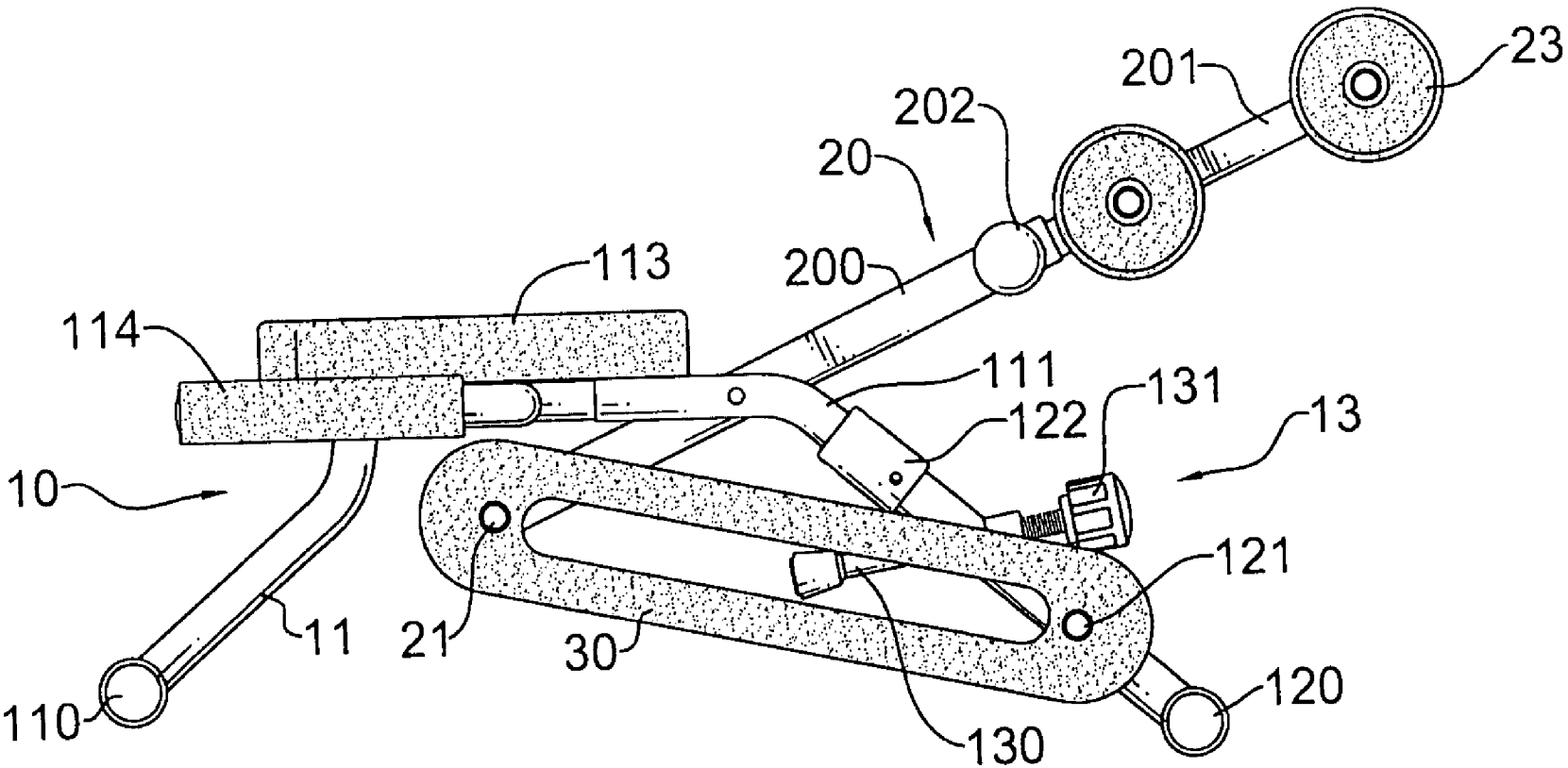
FIG. 5 is an operational side view of the sit up exercising apparatus in FIG. 1.
Figure 6:
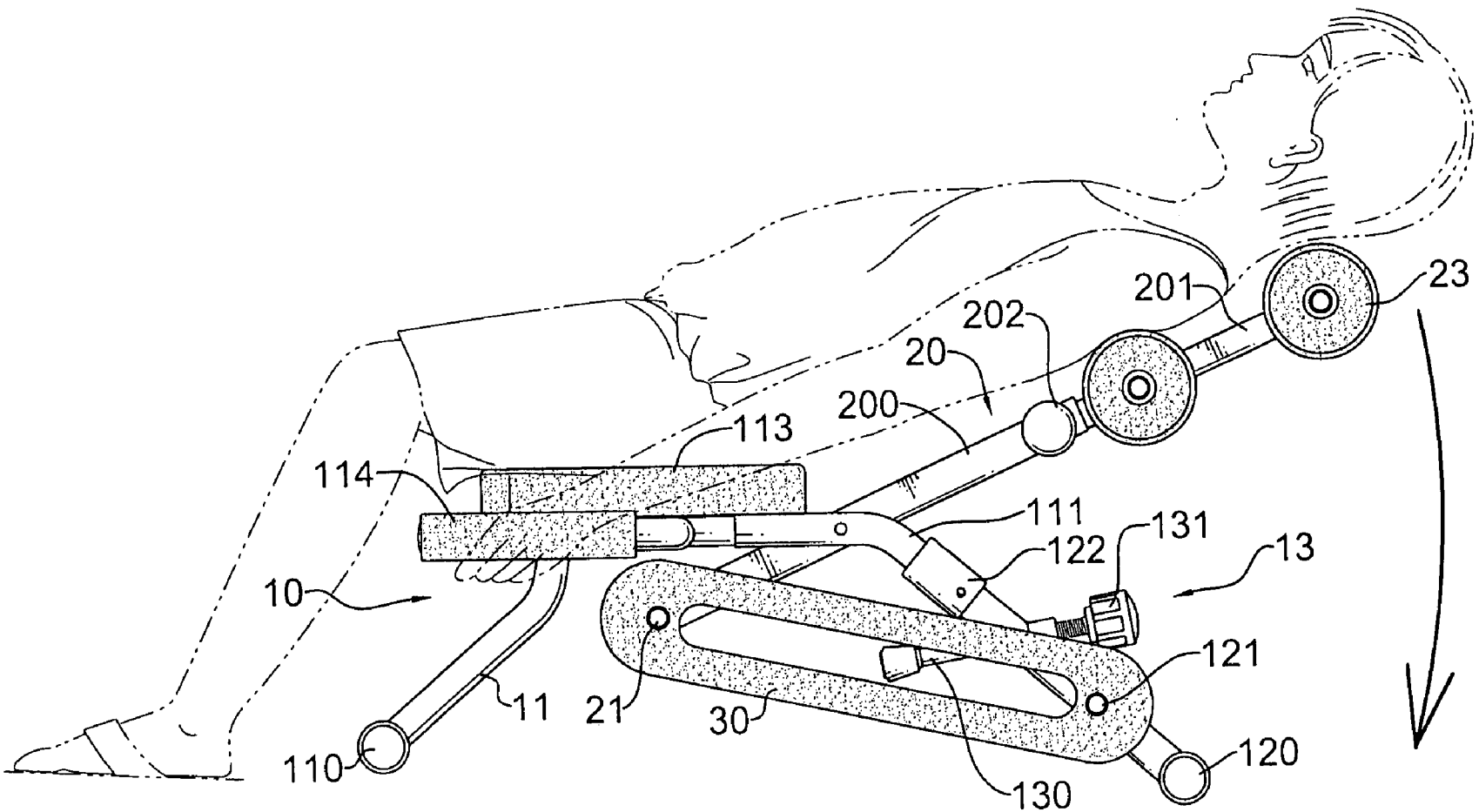
FIG. 6 is an operational side view of the sit up exercising apparatus in FIG. 1 with a person using the sit up exercising apparatus.

With further reference to FIGS. 5 and 6, a person uses the sit-up exercising apparatus by sitting on the cushioned seat (113), holding the grips on the handlebar (114), leaning against the rollers (23) on the actuating bar (20) and pushing the actuating bar (20) against the elastic force of the elastic member (30). The actuating bar (20) pushes against a user's back to help the user sit up, so the user's back is less susceptible to injury and is more comfortable because the rollers on the actuating bar (20) massage the user's back.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A sit up exercising apparatus comprising:

a seat assembly comprising a front leg being an inverted spread U-shape and having a distal end;

a proximal end;

a flat middle section;

a front foot connected transversely to the distal end of the front leg and comprising a pipe connected transversely to the distal end of the front leg and having two ends; and two caps mounted respectively on the ends of the pipe;

a forked connector formed at the proximal end of the front leg and having two tines; and two pivot holes defined respectively in the tines and align with each other;

a cushioned seat mounted on the flat middle section of the front leg and having two sides; and a rear leg connected to the front leg and having a distal end;

a rear foot connected transversely to the distal end of the rear leg and comprising a pipe connected transversely to the distal end of the rear leg and having two ends; and two caps mounted respectively on the ends of the pipe;

a forked proximal end having two tines; and a gap formed between the tines;

two sleeves connected respectively to and protruding from the tines of the forked proximal end and mounted respectively over and connected to the tines of the forked connector of the front leg;

an adjusting device mounted between the tines of the forked proximal end of the rear leg and comprising an extension rod and an adjustment knob; and a stationary mounting rod mounted through and protruding out transversely from the rear leg between the forked proximal end and the distal end;

an actuating bar mounted pivotally between the tines of the forked connector and comprising a proximal end;

a distal end;

opposite sides;

a movable mounting rod mounted transversely through the proximal end of the actuating bar;

two pivot pins connected to and protruding from opposite sides of the actuating bar between the proximal end and the distal end and corresponding to and mounted respectively in the two pivot holes in the tines of the forked connector of the front leg; and multiple rollers connected to and protruding out transversely from the actuating bar near the distal end for massaging a person leaning against the rollers and operating the sit-up exercising apparatus; and two elastic members, each elastic member connected to the stationary mounting rod and the movable mounting rod and having two ends; and two holes formed respectively near the ends to the stationary and movable mounting rods.

2. The sit up exercising apparatus as claimed in claim 1, wherein the actuating bar comprises an outer shaft being hollow, abutting the adjusting device and having a proximal end abutting the adjusting device;

a distal end;

opposite sides; and a threaded setscrew hole formed through one side of the outer shaft near the distal end;

an inner shaft mounted in and protruding from the distal end the outer shaft and having a proximal end mounted slidably in the distal end of the outer shaft; and a distal end; and a setscrew screwing into the threaded setscrew hole in the outer shaft to hold the inner shaft in place and having a threaded rod screwing into the threaded setscrew hole and pressing against the inner shaft; and a knob attached to the threaded rod, the movable mounting rod is mounted transversely through the proximal end of the outer shaft;

the pivot pins are connected to and protrude from opposite sides of the outer shaft between the proximal end and the distal end; and the rollers are connected to and protrude out transversely from the inner shaft near the distal end.

3. The sit up exercising apparatus as claimed in claim 1, wherein the adjusting device (13) is composed of an extension rod and a adjustment knob.

4. The sit up exercising apparatus as claimed in claim 1, wherein the adjusting device (13) is a one piece extension rod and knob.

5. The sit up exercising apparatus as claimed in claim 1, wherein the seat assembly further comprises a handlebar mounted under the cushioned seat and having two ends extending respectively out from the sides of the cushioned seat; and two grips are mounted respectively on the ends.

* * * * *